US005555803A

United States Patent [19]

Holm

[11] Patent Number: 5,555,803

[45] Date of Patent: Sep. 17, 1996

[54] WEB-FED ROTARY OFFSET PRINTING PRESS WITH BRIDGE PRINTING UNITS

[75] Inventor: Helmut Holm, Erlabrunn, Germany

[73] Assignee: Koenig & Bauer Aktiengesellschaft, Wurzburg, Germany

[21] Appl. No.: 492,992

[22] Filed: Jun. 21, 1995

[30] Foreign Application Priority Data

Jun. 21, 1994 [DE] Germany ..... 44 21 437.5

[51] Int. Cl.[6] ..... B41F 5/16

[52] U.S. Cl. ..... 101/180; 101/221

[58] Field of Search ..... 101/181, 211, 101/228, 180, 179, 183, 216, 220, 229, 236–238, 221

[56] References Cited

U.S. PATENT DOCUMENTS 5,142,979 9/1992 Funada et al. ..... 101/183
5,152,222 10/1992 Okamura et al. ..... 101/211
5,179,899 1/1993 Burger et al. ..... 101/181
5,331,890 7/1994 Miyoshi et al. ..... 101/180

FOREIGN PATENT DOCUMENTS 0422365 4/1991 European Pat. Off. .
3130825 2/1983 Germany ..... 101/180

OTHER PUBLICATIONS

Man–Roland Druckmaschinen AG; Offenbach/Main; "Geoman"; Aug. 1993.
"Deutscher Drucker", Sep. 2, 1993, #33, p. G10.

*Primary Examiner*—Ren Yan
*Attorney, Agent, or Firm*—Jones, Tullar & Cooper, P.C.

[57] ABSTRACT

A tower printing unit is formed using a plurality of bridge printing units, each of which has two opposing individual printing units. Ink roller trains in vertically alternating ones of these bridge printing units are oriented either vertically or horizontally. The resultant tower printing unit is more compact and efficient.

2 Claims, 1 Drawing Sheet

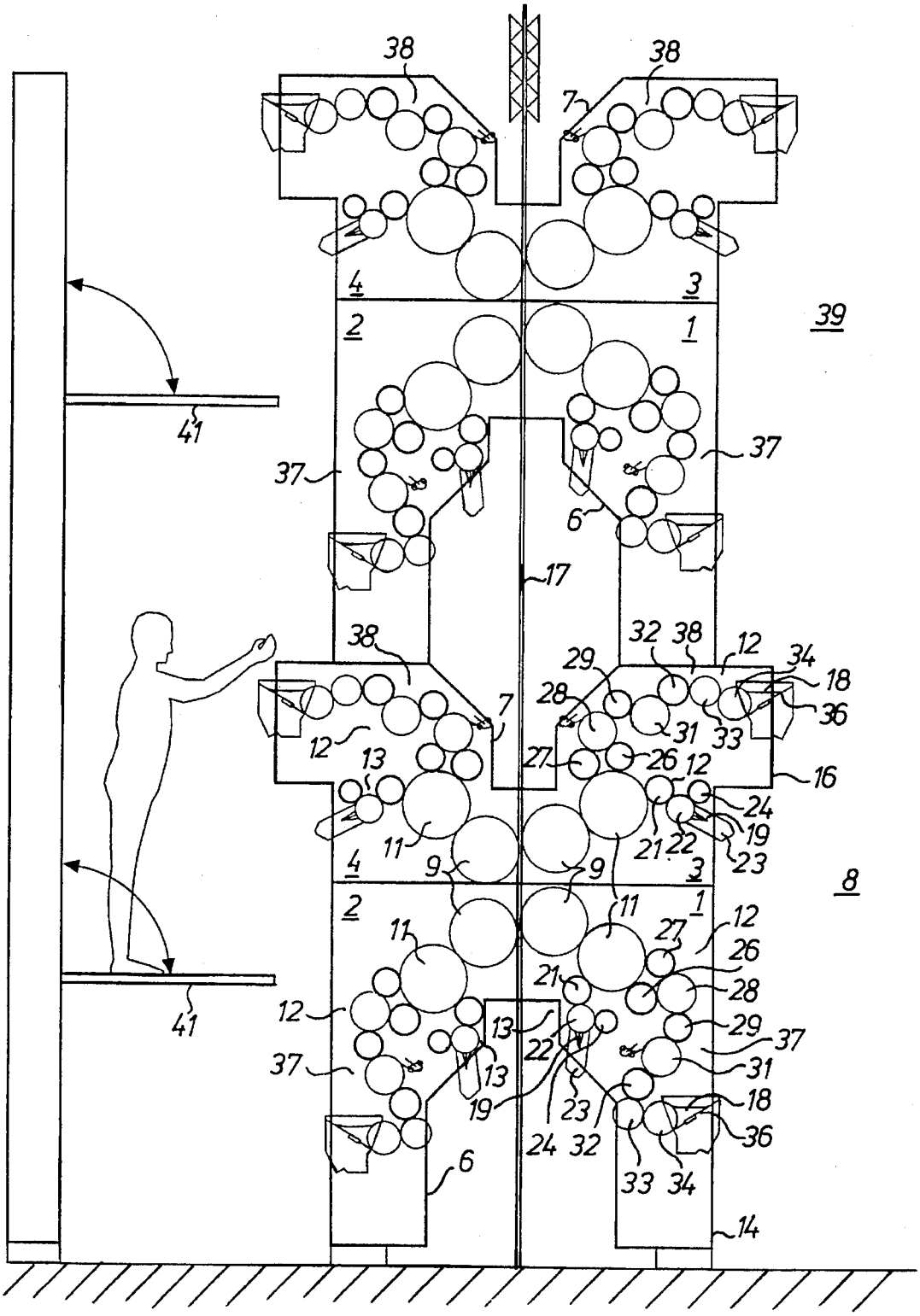
38
38
7
4
3
2
1
39
41
37
37
6
17
38
32 38
12
34
29
18
28
7
36
31
33
12
13
27
26
12
16
24
19
11
21
22
23
4
9
9
3
8
2
11
1
11
27
12
26
21
28
41
12
13
22
29
37
37
13
31
19
23
18
24
32
36
6
33
34
14

WEB-FED ROTARY OFFSET PRINTING PRESS WITH BRIDGE PRINTING UNITS

FIELD OF THE INVENTION

The present invention is directed generally to a web-fed rotary offset printing press with bridge printing units. More particularly, the present invention is directed to web-fed offset printing presses for multi-color printing with at least two bridge printing units. Most specifically, the present invention is directed to a web-fed rotary offset printing press for multi-color printing with at least two bridge printing units having alternatingly arranged vertically and horizontally deployed ink roller trains. Each bridge printing unit consists of two oppositely-located printing units which imprint a vertically extending fabric or paper web which is to be printed in multiple colors on both of its sides. Each printing unit has a rubber blanket cylinder, a printing cylinder and an inking unit together with a dampening unit.

DESCRIPTION OF THE PRIOR ART

It is generally known to position printing units in a tower-like orientation or construction in which individual printing units, or more typically, cooperating pairs of printing units are placed on top of each other in an H-shape. Two such H-shaped units can be placed atop each other to form a so-called tower of eight. Such a tower of eight can be seen in the brochure of the company MAN-Roland Druckmaschinen AG, Offenbach/Main (DE) (RA GEO 08.93.01). In this company publication, one printing unit having such an H-shape consists of two printing unit pairs with the two individual printing units in each pair being disposed in a generally U-shape and with the two U-shaped pairs being disposed in a mirror-reversed orientation with respect to each other to produce the generally H-shaped printing unit. This prior art assembly has four cylinders in a bridge-like construction or orientation.

One limitation of the previously known tower or H-shaped printing units having individual pairs of printing units disposed on top of each other is that it has been necessary for the paper or fabric web being printed to have to travel a long distance between the printing stations. Particularly when two H-shaped printing units are placed atop each other to form a tower of eight, the paper web being printed must travel over a relatively long distance between the printing stations of the two H-shaped printing units. This long relative travel distance is apt to lead to registration errors and problems.

Another problem with prior art tower printing units, particularly when they are placed atop each other to form a tower of eight is the large structural height which such an assembly creates. This results in the need for tall buildings to house these prior art printing presses. In many instances, it is not possible to provide a building having the necessary height.

It will thus be seen that the need exists for a tower printing unit which overcomes the limitations of the prior art. The web-fed rotary offset printing press with bridge printing units in accordance with the present invention provides such a device and is a significant improvement over the prior art devices.

SUMMARY OF THE INVENTION

It is an object of the present invention to provide a web-fed rotary offset printing press with bridge printing units.

Another object of the present invention is to provide a webfed rotary offset printing press for multi-color printing with at least two bridge printing units.

A further object of the present invention is to provide a webfed rotary offset printing press with at least two bridge printing units having alternatingly arranged vertically and horizontally disposed ink roller trains.

Yet another object of the present invention is to provide a web-fed rotary offset printing press with bridge components that has a low structural height.

Even a further object of the present invention is to provide a web-fed rotary offset printing press having bridge components for multi-color printing which provides easy accessibility to the webfed rotary offset printing press.

As will be set forth in detail in the description of the preferred embodiment which is presented subsequently, the web-fed rotary offset printing press in accordance with the present invention has at least two bridge printing units with each bridge printing unit consisting of two oppositely located printing units. These printing units impart a multi-color printing to a generally vertically extending fabric or paper web which passes between the two opposing printing units in each bridge printing unit. Each printing unit includes a blanket cylinder, a printing cylinder and an inking unit having an ink roller train. The inking units associated with a first opposing pair of printing units have their ink roller trains disposed generally vertically while a second or subsequent pair of opposing printing units each have an inking unit whose ink roller train is disposed generally horizontally. The vertically extending ink roller trains are generally parallel to the direction of travel of the web being printed while the generally horizontal ink roller trains are generally perpendicular to the direction of paper web travel.

Several advantages result from the web-fed rotary offset printing press with bridge printing units in accordance with the present invention. A first of these is that the printing press has a low structural height as well as a reduced weight. This reduces, among other things, the cost of the building necessary to house the press and the expense of fabricating the machine base for the press to sit upon.

An additional advantage of the subject invention is the reduced costs necessary to enclose or encapsulate the press because of its lower size and reduced structural height. Such encapsulation of the printing press may be important for reasons of noise pollution or possibly for the recovery of heat in connection with air cleaning.

The reduced structural height of the printing press in accordance with the present invention is also of importance in the reduction of waste paper web which is produced during start and stop operations which occur, for example, during a printing plate change. The more compact the printing unit, the less paper that will be wasted or treated as scrap. Other benefits that accrue from the reduction in overall structural height are a reduction in oscillations in the printing press. In addition, when a wet offset printing process is utilized, the so-called fan-out effect is reduced because of the reduction of the structural height of the assembly. Registration difficulties are reduced in conventional printing processes.

The web-fed rotary offset printing press with bridge printing units in accordance with the present invention overcomes the limitations of the prior art devices. It is a substantial advance in the art.

BRIEF DESCRIPTION OF THE DRAWINGS

While the novel features of the web-fed offset rotary printing press with bridge printing units in accordance with the present invention are set forth with particularity in the appended claims, a full and complete understanding of the invention may be had by referring to the detailed description of the preferred embodiment which is presented subsequently, and as illustrated in the sole drawing FIGURE which is a schematic side elevation view of a webfed rotary offset printing press in accordance with the present invention in a tower of eight construction.

DETAILED DESCRIPTION OF THE PREFERRED EMBODIMENT

Referring now to the sole drawing FIGURE, there may be seen a web-fed offset rotary printing press with bridge printing units in accordance with the present invention. This web-fed rotary offset printing press is usable to accomplish multi-color printing. A first generally H-shaped tower or four color printing tower, generally at 8, has at least four individual printing units 1, 2, 3 and 4. The first and second individual printing units 1 and 2 and the third and fourth individual printing units 3 and 4 each form a so-called bridge printing unit 6 or 7, respectively. Each such bridge printing unit 6 or 7 is generally U-shaped. The four color printing tower or so-called H-shaped printing tower 8 results when the two bridge printing units 6 and 7 are placed one on top of the other with the upper bridge unit 7 being inverted. This means that the upper bridge printing unit 7 is situated as the mirror inverted image of the lower bridge printing unit 6.

Each of the individual printing units 1, 2, 3 and 4 consists essentially of a rubber blanket cylinder 9 which also acts as a counterpressure cylinder in contact with the other blanket cylinder 9 in each unit 6 or 7; a printing cylinder 11, which may be, for example, a printing plate cylinder; an inking unit 12; and a damping unit 13. In each of the individual printing units 1, 2, 3 and 4, the damping unit 13 can be omitted when the printing plates carried by each of the printing cylinders 11 is of a type that is suitable for water-free planographic printing.

The two individual printing units 1 and 2 or 3 and 4 in each of the first and second bridge printing units 6 and 7 respectively are disposed symmetrically to each other about a vertically extending fabric or paper web 17 which will be printed on both sides as it passes between the opposing blanket cylinders 9 of the first and second bridge printing units 6 and 7 of the first printing tower 8. These four individual printing units 1, 2, 3 and 4 are each supported between spaced side frames 14 and 16, with only side frame 14 being shown in the sole drawing FIGURE. The paper web 17 passes initially between the cooperating blanket cylinders 9 of the first bridge printing unit 6 and then between the cooperating blanket cylinders 9 of the second bridge printing unit 7. The respective associated printing cylinder 11 that is associated with each of these blanket cylinders 9 is supplied with ink 18 from its associated inking unit 12, and, if required, is also supplied with dampening fluid 19 from its corresponding dampening unit 13.

As is shown in the sole drawing FIGURE, each of the individual dampening units 13 can be designed as a spray dampening unit. Each such spray dampening unit 13 has a dampening agent application roller 21 which engages the printing cylinder 11 of its associated individual printing unit 1, 2, 3 or 4. This dampening agent application roller 21 is in contact with a dampening agent spreading roller 22. The appropriate dampening agent or dampening fluid 19, applied by the use of a suitable spray unit 23 which is not described in detail, is metered onto this dampening agent spreading roller 22 from a dampening agent metering roller 24.

As may be seen by referring to the sole drawing FIGURE, each of the inking units 12 associated with the four individual printing units 1, 2, 3 and 4 consists of two ink application rollers 26 and 27, which are both in contact with the surface of the associated printing cylinder 11. These two ink application rollers 26 and 27 are also both contacted by an ink spreading cylinder 28. Ink transfer rollers 29, and 32, in conjunction with an intermediate or second ink spreading cylinder 31 and a film roller 33, form an ink roller train 37 or 38, between an ink film roller 33, which is in contact with an ink ductor roller 34 and the respective printing cylinder 11. Ink 18 is disposed in an ink duct which is in engagement with the ink ductor roller 34.

As may be seen in the sole drawing FIGURE, in accordance with the present invention, the ink roller trains 37, which each consist of the ink transfer rollers 29 and 32, and the ink spreading cylinders 28 and 31, are oriented generally vertically in the individual printing units 1 and 2 of the first or lower bridge printing unit 6 of the first H-shaped printing tower 8 and are thus oriented generally parallel to the fabric or paper web 17 which will be printed on. In contrast, in the upper or second bridge printing unit 7 of the first or lower H-shaped printing tower 8, the ink roller train 38 for each of the inking units 12, which again includes the ink transfer rollers 29 and 32, and the ink spreading cylinders 28 and 31, is oriented generally horizontally. Each such ink roller train 38 for each of the inking units 12 in each of the individual printing units 3 and 4 of the upper or second bridge printing unit 7 of the first H-shaped printing tower 8 thus extends generally perpendicularly to the plane of the paper or fabric web 17 to be printed.

It will be understood that the specific number of ink rollers in each of the respective ink roller trains 37 and 38 is selectable. The vertical or horizontal arrangement of the ink rollers in each of the ink roller trains 37 or 38 need not be applied only to the ink transfer rollers 29 and 31 and to the ink spreading rollers 28 and 31. These orientation can also apply to all of the ink rollers in each of the entire respective ink roller trains 37 and 38.

Again as may be seen in the sole drawing FIGURE, a second lower bridge printing unit 6 can be placed atop the first upper bridge printing unit 7 of the first or lower H-shaped printing tower 8. This second lower bridge printing unit 6 corresponds to the first lower bridge printing unit 6 and has its ink roller trains 37 for its inking units 12 disposed in a generally vertical orientation. A second upper bridge printing unit 7, which is the same as the first upper bridge printing unit 7 of the first or lower H-shaped printing tower 8, is placed atop the second lower bridge printing unit 6 and thus forms a second or upper H-shaped printing tower 39. The ink roller trains 38 of the inking units 12 of the second upper bridge printing unit 7 extend generally horizontally. The resultant structure is a so-called tower of eight printing unit which has eight individual printing units forming four bridge printing units which cooperate to print the web 17 on both of its sides in a plurality of colors.

The bridge printing units 6 and 7 are placed atop each other in an alternating sequence. As may be seen in the drawing, these bridge printing units 6 and 7 are alternated so that the resultant tower printing unit has alternating vertically and horizontally extending ink roller trains 37 and 38. Suitable foldable steps or platforms 41 may be provided for use in the operation and the maintenance of the H-printing tower 7 and 39. These printing towers in accordance with the present invention provide a resultant printing structure which is more compact, requires less building space and which has less paper wastage, as compared to the prior art devices.

While a preferred embodiment of a web-fed rotary offset printing press with bridge printing units in accordance with the present invention has been set forth fully and completely hereinabove, it will be apparent to one of skill in the art that a number of changes in, for example the specific sizes of the various rollers and cylinders, their particular drive means, the type of web being printed on, and the like may be made without departing from the true spirit and scope of the present invention which is accordingly to be limited only by the following claims.

What is claimed is:

1. A web-fed rotary offset printing press usable to print multiple colors on a web, said printing press comprising:

first and second bridge printing units, each of said first and second bridge printing units including two oppositely located individual printing units usable to print a vertically extending web on both sides, each of said individual printing units having a rubber blanket cylinder, a printing cylinder, and an inking unit cooperating with said printing cylinder, each of said inking units having an ink roller train including at least first and second ink transfer rollers and first and second ink spreading rollers, said ink roller trains in said two individual printing units of said first bridge printing unit extending generally vertically and parallel to said vertically extending web, said vertically extending ink roller trains affording operator access to said oppositely located individual printing units insaid first and second bridge printing units, said ink roller trains in said two individual printion units of said second bridge printion unit extending generally horizontally and perpendicular to vertically extending web, said horizontally extending ink roller trains affording reduced structural height to said printing press, said first and second bridge printing units being disposed alternatingly on top of each other in a preselectable manner to form a first H-shaped printing tower having a compact structure.

2. The web-fed rotary offset printing press of claim 1 further including a second H-shaped printing tower which is placed beneath said stet H-shaped printing tower to form a tower of eight individual printing units.

* * * * *